United States Patent [19]

Mathis

[11] Patent Number: 4,646,101

[45] Date of Patent: Feb. 24, 1987

[54] ANTENNA SUPPORT

[75] Inventor: Joseph D. Mathis, Naperville, Ill.

[73] Assignee: AT&T Information Systems, Holmdel, N.J.

[21] Appl. No.: 811,063

[22] Filed: Dec. 19, 1985

[51] Int. Cl.[4] ..... H01Q 1/12

[52] U.S. Cl. ..... 343/878; 343/908

[58] Field of Search ..... 343/702, 788, 878, 879, 343/888, 908

[56] References Cited

U.S. PATENT DOCUMENTS

| | | | |
|---|---|---|---|
| 3,349,405 | 10/1967 | Wright | 343/702 |
| 3,378,850 | 4/1968 | Mandl | 343/702 |
| 4,339,756 | 6/1982 | Oyama et al. | 343/702 |
| 4,516,127 | 5/1985 | Siwiak | 343/702 |
| 4,571,595 | 2/1986 | Phillips et al. | 343/702 |
| 4,584,585 | 4/1986 | Makko et al. | 343/702 |
| 4,584,709 | 4/1986 | Kneisel et al. | 343/702 |
| 4,591,863 | 5/1986 | Patsiokas | 343/702 |

FOREIGN PATENT DOCUMENTS

| | | | |
|---|---|---|---|
| 1194925 | 6/1965 | Fed. Rep. of Germany | 343/878 |

*Primary Examiner*—Charles Frankfort
*Assistant Examiner*—Thomas B. Will
*Attorney, Agent, or Firm*—R. F. Kip, Jr.

[57] ABSTRACT

An antenna support is provided by a molded plastic member comprising a block having a vertical passage therein, a horizontal guideway on the top of the block, and detent instrumentalities associated with such guideway. The support is designed for use with a 40 MHz wire rod antenna shaped by multiple "L" bends therein to have a middle section comprising two horizontal arms normal to each other and, at its extremities, two vertical arms normal to the middle section. The support is assembled with the antenna by passing one of the antenna's vertical arms through the vertical passage in the block, and by seating the horizontal antenna arm adjacent that vertical arm into the support guideway so that such horizontal arm is snap-fittably held in that guideway by such detent instrumentalities. Thereafter, the unit consisting of the antenna and its support is assembled with a printed wiring board so that the support maintains the antenna in a predetermined desired positioning thereof relative to the board.

6 Claims, 8 Drawing Figures

ANTENNA SUPPORT

FIELD OF INVENTION

This invention relates generally to supports for radio-frequency antennas and, more particularly, to supports for use with antennas of such kind adapted to be mounted on a printed wiring board.

BACKGROUND OF THE INVENTION

There are now available on the market alarm systems in which transmitter units respond to emergencies of various kinds to generate radio frequency transmissions communicated over wireless links to controllers adapted to provide alerts of such emergencies either by actuating local alarm devices such as sirens, or by sending signals indicative of the occurrence of such emergencies over a wire link to a central office.

One such alarm system is the Emergency Call System ("ECS") made and sold by the American Telephone and Telegraph Company. That system employs transmitter units adapted to be connected to sensors for detecting the happening of various emergency events such as a breaking of glass or a forced door entry (either indicating a forcible intrusion) the presence of smoke or the presence of some other potentially disastrous environmental condition. The transmitter unit comprises a printed wiring board, various electrical components mounted by the board for producing a radio frequency signal in response to detection by such a sensor of the occurrence of such an event, and a small antenna mounted on the board to transmit that signal by a wireless link through space to the controller.

Such an "emergency" signal takes the form of frequency modulation on a 40 MHz carrier, and the antenna for transmitting such signal takes the form of a short piece of wire rod having multiple "L" bends therein to provide the antenna in its middle section with two horizontal arms at right angles to each other and, at its extremities, with two additional vertical arms at right angles to such middle section and fastened at their free ends to the printed wiring board to mounted the antenna's middle section spaced away from the board in fixed parallel relation therewith.

At the relatively high frequency (40 MHz) of the carrier for the emergency signal, any substantial change in the positioning of the antenna from its predetermined desired positioning relative to the board can result in detuning of the antenna and consequent failure or degradation of the wireless link between the transmitter unit and the controller. Such mispositioning or deforming of the antenna can, however, easily occur during board-antenna assembly or later by the antenna being carelessly struck, roughly handled, or otherwise inadvertently misaligned or deformed.

SUMMARY OF THE INVENTION

The problem just described is overcome according to the invention by providing for the antenna a support adapted to be interposed between its middle section and the board and comprising a unitary member constituted of insulative synthetic resinous material and having, as integral parts, a longitudinally extending horizontal central block having formed therein a vertical passage for one vertical arm of the antenna, guide means disposed on the top of the block and defining along such top a longitudinally extending guideway for seating thereon of the horizontal antenna arm adjacent that vertical arm, and detent means at the top of such block for snap-fitting such horizontal block into such guideway. The mentioned vertical passage and the mentioned guideway and detent means are of such character that, when the antenna and its support are assembled together, those two elements become fixedly positioned relative to each other both translationally and angularly. Accordingly, when the unit comprising the antenna and its support are assembled with the board with the support being interposed between the board and the antenna's middle section and in contact with both thereof, the support will maintain the antenna without play in its predetermined desired positioning relative to the board so that mispositioning of the antenna is, in almost all cases, avoided during assembly of the antenna with the board or later. Hence, detuning of the antenna is not likely to occur.

BRIEF DESCRIPTION OF THE DRAWINGS

For a better understanding of the invention, reference is made of the following description of a representative embodiment thereof, and to the accompanying drawings wherein.

DETAILS OF EMBODIMENT

Figure 1:
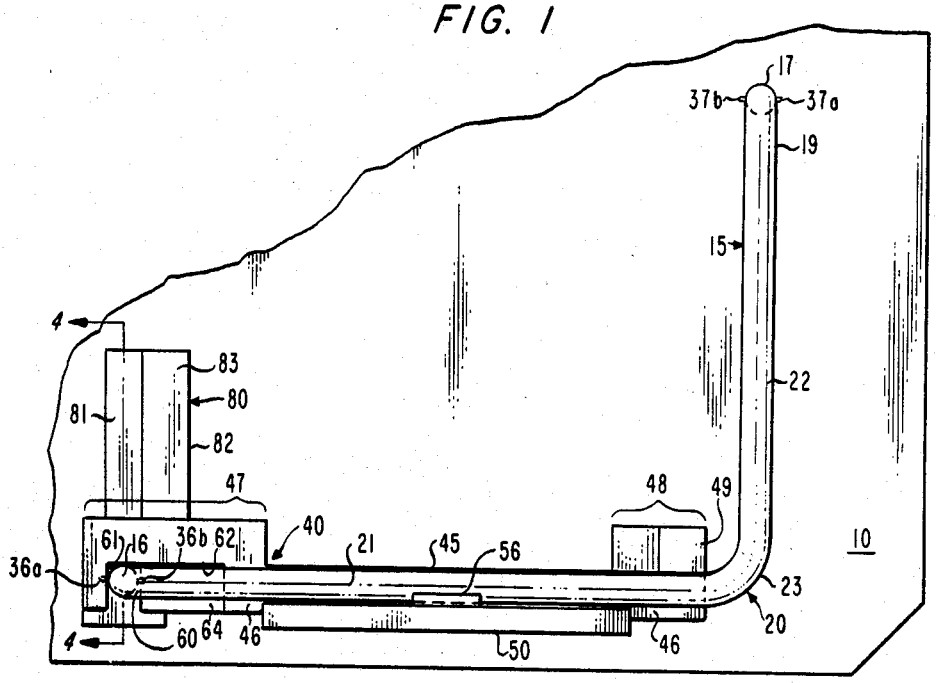
FIG. 1 is a plan view of an assembly according to the invention of a printed wiring board, an antenna mounted on the board and an antenna support mounted on the board between it and the antenna.
Figure 2:
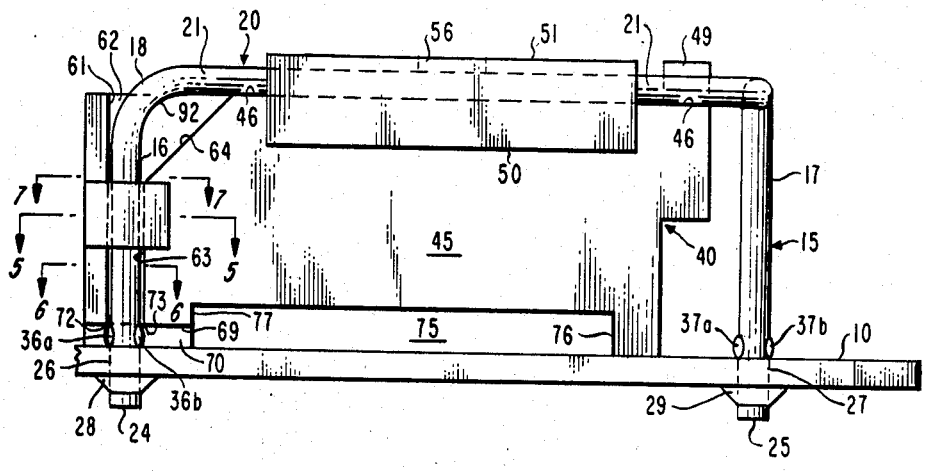
FIG. 2 is a front elevation of the FIG. 1 assembly.

Referring now to FIGS. 1 and 2, the reference numeral 10 generally designates a horizontal printed wiring board on the top of which are various electrical elements (not shown) as, for example, various discrete electrical components, printed electrical conductors, the top openings of plated through holes passing through the board, and conductor pads surrounding such top openings.

Board 10 has mounted thereon a radio-frequency multi-bend wire rod transmitting antenna 15 comprising, as integral parts thereof, two horizontally spaced vertical arms 16 and 17 of circular shape in horizontal cross-section and joined by "L" bends 18 and 19 to a horizontal antenna section 20. Section 20 comprises a longitudinally extending horizontal arm 21 and a laterally extending horizontal arm 22 joined to each other by an "L" bend 23 and joined, respectively, to the vertical arms 16 and 17 by the mentioned "L" bends 18 and 19. Vertical arms 16 and 17 have lower end lengths 24 and 25 received in through holes 26 and 27 in board 10 to extend down beyond such holes so as to have portions projecting downward from the bottom of the board. Solid solder bodies 28 and 29 surround those projecting portions and are fixedly joined thereto and to printed electrical elements (not shown) on such board bottom so as to fasten antenna 15 to board 10 and to electrically couple it to circuitry (not shown) on the board. The vertical antenna arm 16 is swaged above its lower end length 24 to form thereon a pair of spurs 36*a*, 36*b* on longitudinally opposite sides of such arm when antenna 15 is in the position shown in FIG. 1. Vertical antenna arm 17 is similarly swaged to have similar spurs 37*a*, 37*b* above its lower end length 25. The spurs 36 and 37 on arms 16 and 17 increase the cross-sectional dimension of those arms so that they cannot be forced down in through holes 26 and 27 beyond such spurs.

Disposed between board 10 and horizontal antenna arm 21 is an antenna support 40 which is a unitary insulative member constituted of insulative synthetic resinous material as, for example but without restriction, polycarbonate resin. Support 40 may conveniently be a molded plastic piece part which is shaped to comprise various integral parts of the mentioned unitary member.

Figure 3:
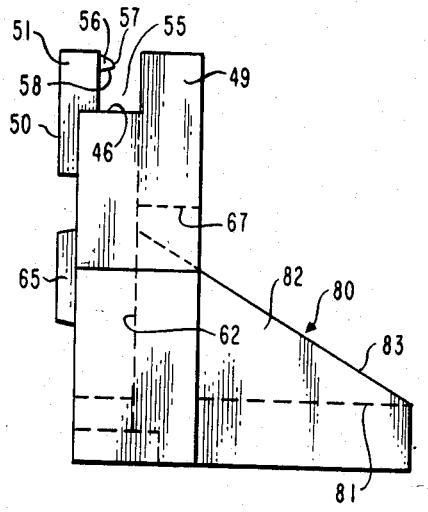
FIG. 3 is a right side elevation of the antenna support of the FIG. 1 assembly without the associated printed wiring and antenna.

Support 40 includes a longitudinally extending horizontal block 45 having on its top a flat longitudinal horizontal guide surface 46. At its left and right hand ends (FIGS. 1 and 2), block 40 has end sections 47 and 48 of which portions project laterally rearward from the guide surface 46. The top of section 47 is coplanar with that surface. End Section 48, however, has to the rear of surface 46 a square lug 49 projecting upward from the level of that surface. On its front side, block 40 has integral therewith a longitudinally elongated horizontal bar 50 which is centrally located between the longitudinally opposite ends of the block. Bar 50 is frontward of guide surface 46, and the bar has an upper portion forming a longitudinal flange 51 projecting upward from the level of that surface. Guide surface 46, the front surface of lug 49 and the rear surface of flange 51 serve together as guide means definitive of a longitudinally extending guideway 55 (FIG. 3) on the top of block 40. Joined to the top rear of flange 51 is detent means in the form of a rearwardly projecting catch 56 overhanging guideway 55. Catch 56 on its top has a downwardly-rearwardly slanting wedging surface 57, and it has also a bottom latch surface 58.

Considering now details of end section 47, that section has formed therein a vertical passage 60 bounded on its left (FIGS. 1 and 2) by a left vertical side wall 61 in a lateral-vertical plane, and bounded at its back by a rear vertical side wall 62 in a longitudinal-vertical plane. On its right, the lower part of passage 60 is bounded by a right vertical side wall 63 joined at its top to the left end of guideway surface 46 by a diagonal surface 64 bounding the upper right hand side of passage 60.

Figure 4:
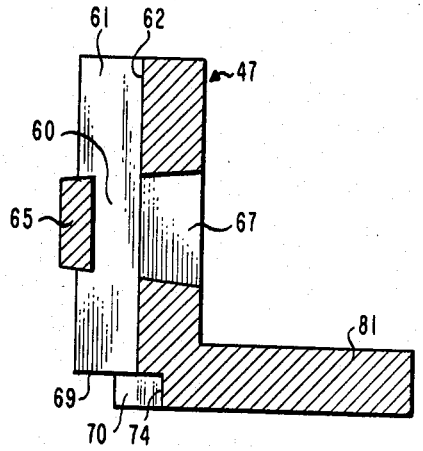
FIG. 4 is a right side elevation in cross-section, taken as indicated by the arrows 4—4 in FIG. 1, of the FIG. 3 support.
Figure 5:
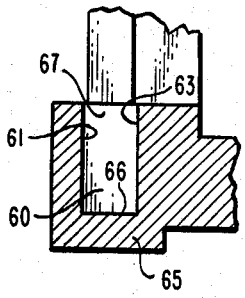
FIG. 5 is a fragmentary horizontal cross-section, taken as indicated by the arrows 5—5 in FIG. 2, of part of the FIG. 3 antenna support.
Figure 6:
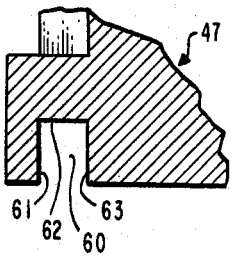
FIG. 6 is a fragmentary horizontal cross-section, taken as indicated by the arrows 6—6 in FIG. 2, of part of the FIG. 3 antenna support.

Over most of its vertical length therefore, passage 60 in its horizontal cross-section has the form of a rectangular "U" with the opening of the "U" being frontward (FIG. 6). In the middle of that vertical extent, however, the frontward opening of passage 60 is spanned by a plastic bridge 65 providing a front wall 66 for the passage (FIG. 5). Bridge 65 is disposed laterally opposite an opening 67 extending from passage 60 (FIG. 4) through end section 47 to the rear side thereof. Because of the presence of bridge 65 the effective horizontal cross-section of passage 60 can be considered to be square.

Passage 60 is terminated at its downward end by its intersection with the roof surface 69 (FIG. 4) of a slot 70 formed in the bottom of end section 47 to extend rearwardly thereinto from the front thereof to a back surface 71 for the slot. Slot 70 undercuts rearwardly the bottom opening of passage 60, and the roof surface 69 of the slot provides downward facing shoulders 72 and 73 (FIG. 2) adjacent that opening on longitudinally opposite sides thereof and, also, another downward facing shoulder 74 (FIG. 4) rearward of that opening.

A larger slot 75 is formed in the bottom of the central part of block 45 to pass laterally all the way through that block. As a result, the unitary member 40 is supported on printed wiring board by (FIG. 2) a right hand foot 76 and a left hand foot 77 provided by end section 47.

To stabilize support 40 against lateral rocking on board 10, the bottom surface of foot 77 is extended rearwardly by a prop 80 (FIG. 1) projecting laterally outward from the block 45. Prop 80 comprises (FIGS. 2, 3, 4) a horizontal base 81 resting on board 10 and a vertical brace 82 having a diagonal top surface 83 and joining the top of base 81 to the back side of the block 45.

ASSEMBLING THE EMBODIMENT

Antenna 15, antenna supper 40 and printed wiring board 10 are assembled together as a manner as follows.

As a first step, antenna 15 and support 40 are brought into juxtaposition with horizontal arm 21 of the antenna being parallel to the horizontal plane of guide surface 46 of the support, and with the lower end of vertical arm 16 of the antenna being over vertical passage 60 in the block. While retaining such positioning of antenna arms 21 and 16 relative to support 40, antenna 15 is adjusted to angularly displace the axis 90 (FIG. 7A) of arm 21 to an angle of forty-five degrees with the centerline 91 of guideway 55. The antenna 15 and support 40 are then vertically moved relatively towards each other to insert vertical antenna arm 16 in the passage 60 in the support. With horizontal antenna arm being angularly displaced forty-five degrees from guideway centerline 91, spurs 36*a* and 36*b* on vertical arm 16 fit with clearance into the lower left-hand and upper right corners of the effective square horizontal cross-section of passage 60 to thereby permit full insertion of that vertical antenna arm into such passage. In such connection, the widening of the upper part of passage 60 by its diagonal wall surface 64 furthers such full insertion by accommodating in the top of such passage the bent upper portion 92 of arm 16. When arm 16 is fully inserted into passage 60, the circular horizontal cross-section (FIG. 7A) of the arm has a close fit with the bounding walls 61, 62, 63, 66 of the passage. Accordingly, the insertion of the arm 16 into passage 60 causes antenna 15 to be restrained against any significant translational movement relative to support 40 in both the longitudinal and lateral horizontal dimensions. The antenna is, however, still free to move angularly relative to support 40 about the axis of the vertical antenna arm 16.

After full insertion, as described, of such antenna arm into the support passage 60, the spurs 36*a*, 36*a* on the arm are positioned below the roof surface 69 of the slot 70 formed in support 40. With horizontal antenna arm 21 being maintained at its forty-five degrees angular displacement relative to guideway centerline 91 (FIG. 7A), arm 16 can be retracted from passage 60 by moving the arm upward relative to support 40. When, however, arm 21 is angularly shifted from that forty-five degree displacement by a relatively small angular amount towards centerline 91 to produce a corresponding angular shift of spurs 36*a*, 36*b* clockwise about the axis of arm 16, that angular shift of the spurs brings them under the shoulders 72, 73 (FIG. 2) provided by slot roof surface 69 so that such spurs upon contacting those shoulders will stop further upward movement of arm 16. Similarly, if arm 21 is angularly shifted by a small amount from its forty-five degree position (FIG. 7*a*) away from guideway centerline 91, the corresponding counter-clockwise angular shift in spur 36*b* brings that spur under shoulder 74 (FIG. 4) so that such spur by contacting the latter shoulder will stop upward movement of arm 16.

Figure 7A:
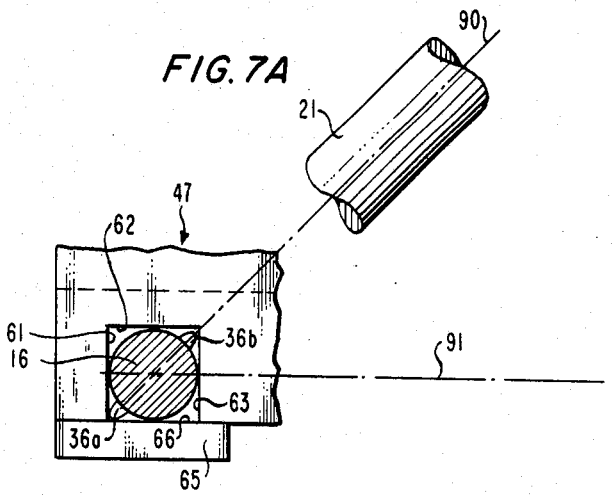
FIGS 7A and 7B are schematic horizontal cross-sections, taken as indicated by the arrows 7—7 in FIG. 2, and illustrative of a particular cooperation between the FIG. 3 antenna support and the antenna shown in FIGS. 1 and 2.

It follows from the foregoing that, unless horizontal arm 21 is positioned within a small range of angular positions therefor centered on the forty-five degree position shown in FIG. 7A, arm 16 cannot be retracted out of passage 60 in support member 40. When arm 21 is outside of that range, arm 16 has in passage 60 some small vertical play between limits established by the stopping by shoulders 72–74 of upward movement of spurs 36*a*, 36*b* and the stopping of downward movement of arm 16 by the coming into contact of horizontal arm 21 with the top of block 45. Apart from such small vertical play, however, antenna 15 is locked with support 40 except when, as mentioned, antenna arm 21 is within a small range of angular positions therefor. Such locking together of elements 15 and 40 is advantageous in assembling operations since it permits those elements to be handled in those operations as an assembled unit not likely to come apart.

Figure 7B:
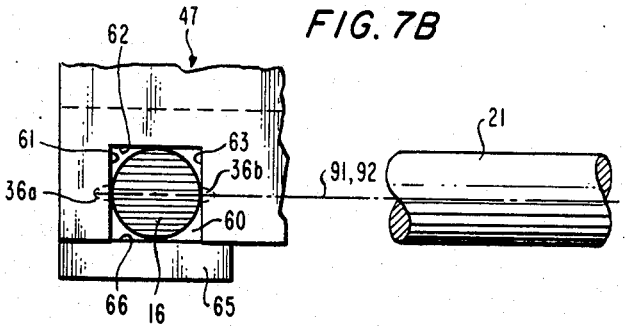

After arm 16 has been inserted, as described, in passage 60 of support 40, the horizontal antenna arm 21 is angularly moved from its position shown in FIG. 7A to that shown in FIG. 7B for which the axis 90 of such arm coincides with the centerline 91 of guideway 55. That angular movement of arm 21 is implemented as follows. First antenna is angularly swung clockwise until the right hand end arm of 21 strikes the back of lug 49. Next, with spurs 36*a*, 36*b* of arms 16 being in contact with shoulders 72, 73 so that such arm is stopped in upward movement, the right hand end of horizontal arm 21 is resiliently deflected upward and then swung further clockwise to pass over lug 49 and to position the center of that arm in contact with the upper surface of catch 56. Then downward manual force is applied at the center of horizontal arm 21 to cause that arm to slide down on wedging surface 57 of the catch and, in the course of such sliding, to be resiliently bowed rearwardly by such surface enough for the arm to move downwardly past catch 56. When that happens, arm 21 snaps back into its normal resiliently unstressed straight configuration to thereby become seated in a snap-fitted manner in guideway 55 and to be releasably held in that guideway by latch surface 58 of catch 56. When so seated, arm 21 is held therein with its axis 90 in coincidence with guideway centerline 91 by a close fit made between the cross-section of the arm and the bottom surface 58 of catch 56, the rear surface of flange 51, the front surface of lug 49 and the front wall surface 62 (FIG. 2) of end section 47. By suitable manipulation, however, arm 21 is releasable from its held position in guideway 55.

When arm 21 has been snap-fittably seated, as described, in guideway 55, the antenna 15 and support 40 are locked together to be substantially fixed in their positioning relative to each other in all three of their translational coordinates and in all three of their angular coordinates. Thus they provide an assembled unit of elements 15 and 40 in which there is no play in any of such angular or translational coordinates between such two elements. That unit is placed over printed wiring board 10, the lower end lengths 24 and 25 (FIG. 2) of vertical arms 16 and 17 of antenna 15 are passed down through holes 26 and 27 in such board, and the tips of such lengths which project down beyond the bottom of that board are then fastened thereto by soldering resulting in the shown solder bodies 28 and 29 so as, thereby, to complete the assembly of antenna 15, support 40 and board 10. With support 40 being thus interposed between board 10 and horizontal section 20 of the antenna and in contact with both thereof, the antenna cannot be warped or deformed in its positioning relative to the board and accordingly cannot become detuned by subsequent forceful handling of the board-antenna-antenna support assembly.

The above described embodiment being exemplary only, it is to be understood that additions thereto, omissions therefrom and modifications thereof can be made without departing from the spirit of the invention. Accordingly, the invention is not to be considered as limited save as is consonant with the scope of the following claims.

What is claimed is:

1. An antenna support for use with a wire rod antenna comprising a vertical arm and a horizontal arm joined by an "L" bend, said support being a unitary member constituted of insulative synthetic resinous material and comprising, as integral parts thereof, the following, a longitudinally extending horizontal central block having formed therein a vertical passage for reception therein of said antenna's vertical arm so that said antenna will be restrained in translation relative to said block in the longitudinal and lateral horizontal coordinates of said block, guide means disposed on top of said block to one longitudinal side of said passage and defining along the top a longitudinally extending guideway for seating therein of said antenna's horizontal arm, and detent means at the top of said block for snap-fitting said horizontal arm into said guideway and for thereafter releasably locking said horizontal arm in seated relation in said guideway so as to restrain said antenna against horizontal angular movement thereof relative to said block.

2. An antenna support according to claim 1 in which said vertical arm of said antenna with which said support is used is of circular shape in horizontal cross-section and has at its lower end at least one spur projecting outward from said vertical arm, said passage is square in effective horizontal cross-section to permit the passing therethrough of said spur by horizontal angular displacement of said antenna away from said guideway, and in which said block has formed therein below a bottom opening of said passage a cavity extending in a horizontal dimension beyond said bottom opening so as to be adapted to accommodate said spur in said cavity when said antenna is locked in said guideway.

3. An antenna support according to claim 2 in which said cavity has therein adjacent the bottom of said passage a downward facing shoulder adapted by engagement with said spur to restrain said antenna from upward movement relative to said block over a range of horizontal angular positions of said antenna relative to said block.

4. An antenna support according to claim 1 in which said support is part of a combination also comprising said antenna of which said vertical arm thereof is received in said passage.

5. An antenna support according to claim 1 in which said unitary member further comprises, as an integral part thereof, a position-stabilizing foot projecting laterally outward from said block and adapted to steady said block when placed on a mounting surface therefor.

6. A combination comprising, a horizontal printed wiring board, a multi-bend wire rod antenna comprising, as integral parts thereof, first and second horizontally spaced vertical arms each having a top and bottom end, said respective bottom ends being soldered to said board, and a horizontal antenna section comprising first and second horizontal arms commonly joined by an "L" bend in said antenna and joined at their ends away from said bend to, respectively, said first and second vertical arms by other "L" bends in said antenna, and an antenna support in the form of a unitary member constituted of synthetic resinous material and comprising, as integral parts thereof, the following, a longitudinally extending central block disposed on said board and having formed therein a vertical passage through which extends said first vertical antenna arm with the top and bottom ends of said first vertical arm being, respectively, above said block and soldered to said board, guide means disposed on top of said block and defining along the top a longitudinally extending guideway which is to one longitudinal side of said passage and which has seated therein said first horizontal antenna arm, and detent means at the top of said block and engaging said first horizontal antenna arm so as to snap-fittably detain said horizontal arm in seated relation in said guideway and to releasably lock said block and antenna together.

* * * * *